US006460529B2

(12) United States Patent
Pullin

(10) Patent No.: US 6,460,529 B2
(45) Date of Patent: Oct. 8, 2002

(54) ARCHERY BOW TRIGGER SAFETY LOCK

(76) Inventor: David L. Pullin, 2610 N. Augusta St., Staunton, VA (US) 24401

( * ) Notice: Subject to any disclaimer, the term of this patent is extended or adjusted under 35 U.S.C. 154(b) by 18 days.

(21) Appl. No.: 09/776,919

(22) Filed: Feb. 6, 2001

(65) Prior Publication Data

US 2002/0104522 A1 Aug. 8, 2002

(51) Int. Cl.[7] ..... F41B 5/18
(52) U.S. Cl. ..... 124/35.2; 124/40
(58) Field of Search ..... 124/35.2, 40

(56) References Cited

U.S. PATENT DOCUMENTS 4,672,945 A * 6/1987 Carlton ..... 124/35.2
4,854,293 A * 8/1989 Roberts ..... 124/35.2
5,649,524 A 7/1997 Pullin ..... 124/35.2
5,666,936 A * 9/1997 Estrada ..... 124/35.2
6,032,661 A 3/2000 Goff et al. ..... 124/35.2

* cited by examiner

*Primary Examiner*—John A. Ricci
(74) *Attorney, Agent, or Firm*—Brady, O'Boyle & Gatos

(57) ABSTRACT

An archery bow trigger safety lock wherein an arm is pivotally connected to the exterior wall surface of the housing of an archery bow trigger mechanism including a trip lever having a portion extending outwardly of the housing. The arm overlies the trip lever to lock the trigger mechanism in the safety mode and is pivotal to either side of the trip lever to place the trigger mechanism in the release mode.

3 Claims, 1 Drawing Sheet

ARCHERY BOW TRIGGER SAFETY LOCK

BACKGROUND OF THE INVENTION

The safety lock of the present invention is adapted to be mounted on an archery bow trigger mechanism of the type disclosed in applicant's U.S. Pat. No. 5,649,524 dated Jul. 22, 1997, the details of which are incorporated herein by reference.

The trigger mechanism disclosed in the above-mentioned patent is provided with a safety catch comprising a bolt threadably mounted in the trigger housing and adapted to engage the trip lever of the trigger mechanism. While the bolt provided an adequate safety lock, it was somewhat cumbersome to manipulate the bolt to the release position while holding the bow string and associated trigger in the cocked position.

After considerable research and experimentation, the safety lock of the present invention has been devised to overcome the disadvantages experienced with the aforementioned bolt-type safety lock so that the archer can easily move the safety lock to the released position while holding the bowstring at a full drawn position.

SUMMARY OF THE INVENTION

The archery bow trigger safety lock of the present invention comprises, essentially, an arm pivotally connected to the housing of a trigger mechanism of the type shown in U.S. Pat. No. 5,649,524, wherein the arm is positioned adjacent the upper end portion of the trip lever and adapted to be selectively pivoted to a position overlying the trip lever to thereby lock the trigger, and to a position away from the lever to release the trigger. By the construction and arrangement, the pivotally mounted arm can easily be pivoted in either direction by the archer's thumb to move the safety lock to the released position while the bowstring is being held at a full drawn position.

DESCRIPTION OF THE PREFERRED EMBODIMENT

Figure 1:
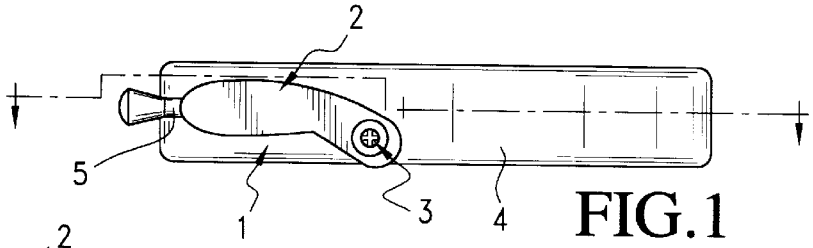
FIG. 1 is a top plan view of the safety lock of the present invention mounted on the housing of an archery bow trigger mechanism and overlying the trip lever for holding the trigger mechanism in the safety or locked position.
Figure 2:
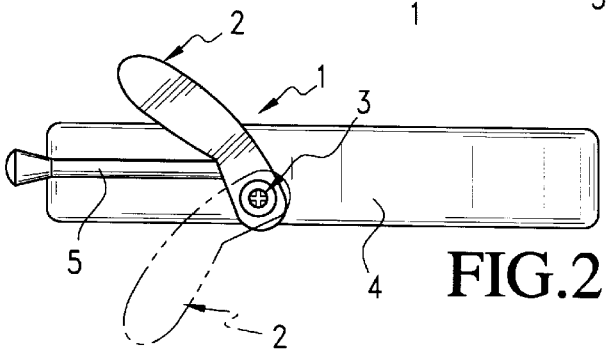
FIG. 2 is a top plan view of the safety lock as shown in FIG. 1, showing the safety lock pivoted in directions away from the trip lever for releasing the trigger mechanism from the locked position.

Referring to FIGS. 1 and 2, the safety lock 1 of the present invention comprises an arm 2 pivotally connected as at 3 to a housing 4 of an archery bow trigger mechanism having a trip lever 5 extending outwardly from the housing 4. The arm 2 is positioned to overlie the trip lever 5, as shown in FIG. 1 to hold the trigger mechanism in the safety or locked position. By pivoting the arm 2 in either direction away from the trip lever 5, as shown in FIG. 2, the trigger mechanism is no longer in the safety or locked mode.

Figure 3:
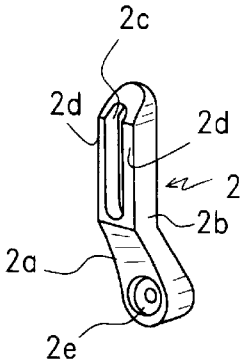
FIG. 3 is a perspective view of the safety lock of the present invention.

The details of the arm 2 are illustrated in FIG. 3 where it will be seen that the arm 2 has a hub portion 2*a* through which the pivotal connection 3 extends and an offset portion 2*b* adapted to overlie the trip lever 5. The offset portion 2*b* is provided with a longitudinally extending recess 2*c* having longitudinally extending side walls 2*d*. When in the safety or locked position, the trip lever 5 is positioned in the recess 2*c* and the side walls 2*d* provide stop members for holding the arm 2 in the safety position.

Figure 4:
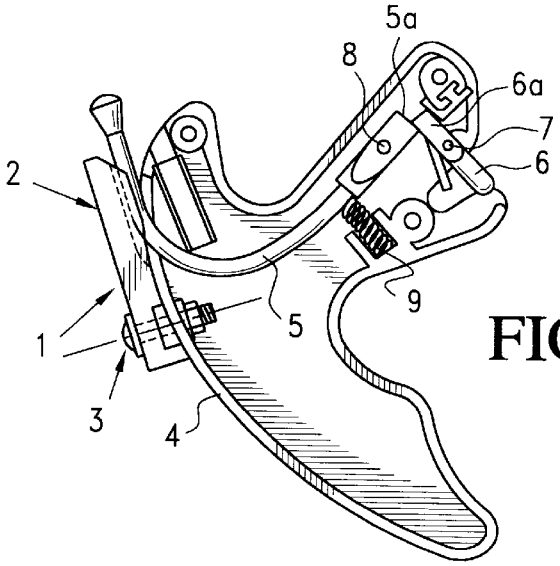
FIG. 4 is a view taken along line 4—4 of FIG. 1.
Figure 5:
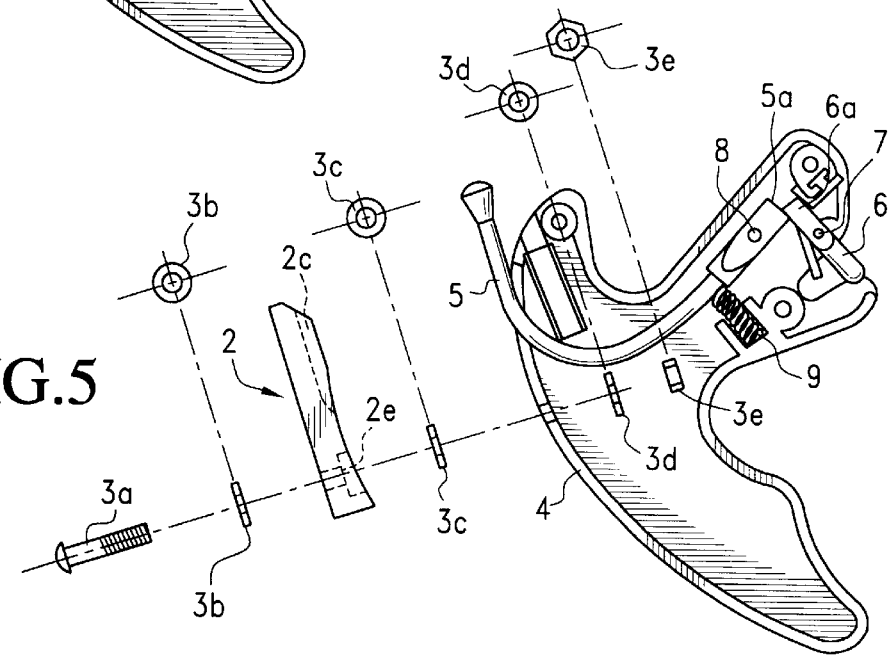
FIG. 5 is a side elevational view of the trigger mechanism and associated safety lock, as shown in FIG. 4, illustrating an exploded view of the safety lock components.

The archery bow trigger mechanism on which the safety lock 1 of the present invention is mounted is a conventional trigger mechanism as disclosed in the aforementioned U.S. Pat. No. 5,649,524 and as illustrated in FIGS. 4 and 5 and comprises, essentially, a latch 6 pivotally connected to the housing as at 7. The trip lever 5 is also pivotally connected to the housing 4 as at 8. A compression spring 9 is mounted between the housing 4 and trip lever 5 for biasing the trip lever 5 in a clockwise direction. When cocking the trigger mechanism, a bowstring (not shown) is connected to the latch 6 and the trip lever 5 pivots in a clockwise direction so that the distal end 5*a* thereof abuts the end portion 6*a* of the latch 6. When the archer pushes the free or proximate end of the trip lever 5 downwardly, causing the trip lever 5 to pivot in a counterclockwise direction, the distal end 5*a* of the trip lever 5 moves away from the end portion 6*a,* whereby the latch 6 and associated bowstring are released.

The pivotal connection 3 of the arm 2 to the housing 4 comprises a threaded bolt 3*a* extending through a washer 3b positioned on the outer surface of the arm 2. The bolt 3*a* extends through a counterbore 2*e* provided in the hub portion 2*a* of the arm 2. A resilient 0-ring 3*c* is positioned in the counterbore 2*e* through which the bolt 3*a* extends into the interior of the housing 4 and through a washer 3*d,* the assembly being fastened by a nut 3*e* threaded to the end of the bolt. By the construction and arrangement of the pivotal connection 3, the arm 2 is allowed to be pivoted in either direction to the released position as shown in FIG. 2, and the resilient 0-ring 3*c* provides a flexibility to the pivotal connection allowing the side walls 2*d* of the arm 2 to be lifted over the trip lever 5.

From the above description, it will be readily appreciated by those skilled in the art that the safety lock of the present invention is an improvement over the threaded-bolt type safety lock in that it is more accessible to the archer, and it is more user friendly since it can be easily manipulated by either a right or left handed archer to pivot the arm in either direction to release the trip lever.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. In combination, a safety lock and an archery bow trigger mechanism comprising a housing, a trip lever positioned in said housing, means pivotally connecting one end portion of said trip lever to said housing, the opposite end of said trip lever extending outwardly from said housing, a latch positioned in said housing, means pivotally connecting said latch to said housing, said one end portion of said trip lever being adapted to abut said latch to hold said latch in a cocked position, said one end portion of said trip lever being movable away from said latch by pushing on said opposite end of said trip lever to thereby release the latch; said safety lock comprising an arm positioned exteriorly of the housing in proximity to said opposite end of said trip lever, and means pivotally connecting said arm to said housing, whereby the arm can be selectively pivoted to a position overlying the trip lever to thereby place the trigger mechanism in a lock mode, and to a position away from the trip lever, to thereby place the trigger mechanism in a release mode.

2. The combination according to claim 1 wherein the arm comprises a hub portion through which the pivotal connection extends and an offset portion integral with the hub portion adapted to overlie the trip lever, a longitudinally extending recess provided in said offset portion adapted to receive said trip lever, and said recess having longitudinally extending side walls providing stop members for holding the arm in the position overlying said trip lever.

3. The combination according the claim 2 wherein the means for pivotally connecting the arm to the housing comprises a nut and bolt assembly connecting the hub portion of said arm to an exterior wall surface of said housing, a resilient O-ring extending around said nut and bolt assembly and positioned between the hub portion of the arm and the exterior surface of said wall to thereby provide a flexible connection between the arm and the housing, whereby the recess side walls can be lifted over the trip lever when pivoting the arm to the released position.

* * * * *